United States Patent [19]

Schott

[11] 4,099,400

[45] Jul. 11, 1978

[54] VERSATILE EXPANDING APPARATUS FOR TUBES AND THE LIKE

[75] Inventor: Donald E. Schott, Chester, Vt.

[73] Assignee: Thomas C. Wilson, Inc., Long Island City, N.Y.

[21] Appl. No.: 779,792

[22] Filed: Mar. 21, 1977

[51] Int. Cl.[2] ..... B21D 39/10

[52] U.S. Cl. ..... 72/122; 72/125

[58] Field of Search ..... 72/125, 122

[56] References Cited

U.S. PATENT DOCUMENTS

| | | | |
|---|---|---|---|
| 901,271 | 10/1908 | Wiedeke | 72/122 |
| 2,649,889 | 8/1953 | Dudley | 72/125 |

*Primary Examiner*—Lowell A. Larson

*Attorney, Agent, or Firm*—Pennie & Edmonds

[57] ABSTRACT

An apparatus for expanding an end portion of a tube positioned within an opening defined by an outer member is disclosed. Such apparatus comprises a generally elongated first housing having one end portion adapted to be inserted into the tube including a plurality of rollers, mounted in the housing for expanding the end portion of the tube outwardly in engaged relation with peripheral portions of the outer member forming the opening and for developing forces directed axially into the tube. A mandrel having a taper opposite that of the rollers is positioned therebetween and inserted in the first housing to operatively cooperate with the rollers to outwardly expand the tube and develop generally axial and inward forces. A second housing is adapted to be securedly positioned along pre-selected locations of the first housing and having at least a first open end portion which faces the outer member and the end portion of the tube. A reversible collar member having first and second free end portions is adapted to be removably positioned within the opening of the second housing in at least one of two positions. In the first position, the first free end portion is configured to be engaged at least with the outer member in a manner to permit the tubular member to be expanded so as to extend a predetermined distance outwardly of the outer member. In the second position, the second free end portion is configured to be engaged at least with the outer member to retain the end of the tube substantially continuous with surface portions of the outer member.

12 Claims, 4 Drawing Figures

VERSATILE EXPANDING APPARATUS FOR TUBES AND THE LIKE

BACKGROUND OF THE INVENTION

1. Field of the Invention

This particular invention, in general, pertains to a thrust collar apparatus for use in conjunction with tube expanding tools of the roller and mandrel type which primarily function to expand tubes situated within corresponding openings formed in a tube sheet or other like structure. In particular, the present invention is related to a novel and improved reversible thrust collar apparatus which, in association with a tube expander apparatus, easily facilitates, in a simple and reliable fashion, the expansion of tubes having ends flush with or projecting from a tube sheet.

2. Description of the Prior Art

Typically, rotary expanding tool assemblies of the roller and mandrel type are characterized as including a cage member having an externally threaded portion, and a plurality of discrete circumferentially spaced and longitudinally extending slots which are skewed. The slots carry a plurality of conventional tapered expanding rollers. Also, the cage member of the above assembly rotatably surrounds a tapered rotatable mandrel passing therethrough which contacts the rollers. In operation, the mandrel is rotatably driven, in any suitable manner, after the tube expanding assembly with mandrel and cage have been inserted into the tube. Ordinarily during rotation of the mandrel, it is advanced so as to force the expanding rollers radially outwardly into contact with the tube. Since the rollers make contact with the inner surface of the tube, rotation of the mandrel results in the cage member being correspondingly rotated. By virtue of the expanding rollers being skewed with respect to the axes of the mandrel and cage, the cage is drawn into the tube until stopped by a stop collar member connected to and rotatable with the cage member which abuttingly engages either the end of the particular tube being expanded or the associated tube sheet. In situations wherein the stop collar initially contacts the tube sheet, the further rotation of the cage tends to pull the tube outwardly. This linear movement is arrested whenever the end of the tube abuts the stop collar. The stop collar ordinarily functions to, among other things, control positioning of the tube end relative to the tube sheet and hold the tube which is to be expanded from rotation.

As a consequence of the foregoing, the expanded tube is securely fastened within the sheet and may form, for example, a fluid-tight joint which protects against leakage. Customarily, such kinds of tube expanders would be in conjunction with tubes for use in heat exchangers, condensers, and the like.

One of the difficulties frequently encountered in expanding such tubes in tube sheets or the like arises by virtue of the fact that many of the tubes to be expanded project from the associated tube sheet, while other tubes are flush with the face of such sheets. This situation in actual practice presents a rather significant limitation to an operator insofar as the conventional approach commonly employed is to utilize separate expanders on hand for each situation or apply different stop collars to the tube expander assemblies. It is evident, of course, that with this type of approach besides a burdensome and cumbersome task for the operator being developed there are significant drawbacks relating to the additional and unnecessary costs involved through use of different tube expander assemblies and/or collars therefor.

Heretofore known stop collar mechanisms for overcoming the above noted disadvantages associated with tube ends flush with or extending from the tube sheet or the like are characterized as being relatively more complicated in construction and more costly to produce and require tedious and precise adjustments for each different situation. By way of specific example, U.S. Pat. Nos. 1,680,922 and 2,649,889 generally describe thrust collars which are adjustable so as to accommodate for tube ends which may be either flush or project from the face of the tube sheet. In particular, the above patents each disclose a tube expander having an adjustable stop collar which is provided with an external threaded portion adapted to be threaded onto a sleeve member mounted on the thrust collar housing so that the axial position of the stop collar with respect to the end of the sleeve member can be adjusted as desired. This form of construction enables the tube expander to accommodate tubes having ends which are either flush with, or project from, the tube sheet. In the case of the former situation, the stop collar is positioned so that its end is flush with that of the sleeve member. As to the latter situation, the stop collar is positioned so that its end extends beyond the end of the sleeve member by a distance equal to the distance the tube is to project from the sheet.

Although the tube expanders described in the aforementioned patents can accommodate both flush and projecting tube ends, the position of the stop collar must be repeatedly readjusted since the depth of the recess defined by the interior of the stop collar and the end portion of the sleeve member must be set fairly accurately when the tool is used to expand tubes with projecting ends. This adjustment problem is rather time consuming. This problem is magnified when it is considered that during a typical installation for a boiler or heat exchanger there may be hundreds of tube ends which need to be expanded by the operator.

Moreover, the overall constructions of the noted category of stop collar apparatus is relatively expensive, especially given the need for cooperating threaded surfaces. Also, prior art arrangements do not permit the expander tool and stop collar to be readily converted for use with either flush or projecting tube ends in a manner which is as easy and rapid as could otherwise be desired.

In context of the prior art, I have invented an apparatus which overcomes the earlier noted shortcomings generally encountered in connection with known thrust collar devices used in association with tube expanding assemblies by providing a simple, versatile, economical, reliable, unique and unobvious apparatus including a thrust collar apparatus with a reversible collar for expanding tubes and the like which have their ends either projecting from the tube sheet or not.

SUMMARY OF THE INVENTION

Broadly, in accordance with the principles of this invention, there is embodied an apparatus for expanding an end portion of a tubular member positioned within an opening defined by an outer member. The apparatus of this invention embodies a generally elongated first housing having one end portion adapted to be inserted into the tubular member. Such invention contemplates means in the housing for expanding the end portion of the tubular member outwardly in engaged relation with peripheral portions of the outer member forming the opening and for developing forces directed axially into the tubular member. The invention comprises a second housing adapted to be securedly positioned along preselected locations of the first housing and having at least a first open end portion which faces the outer member and the end portion of the tubular member. The present invention comprises a reversible collar member having first and second free end portions adapted to be removably positioned within the opening of the second housing in at least one of two positions. In the first position, the first free end portion is configured to be engaged at least with the outer member to permit the tubular member to be expanded so as to extend a predetermined distance outwardly of the outer member. In the second position wherein the second free end portion is configured to be engaged at least with the outer member to retain the end of the tubular member substantially continuous with surface portions of the outer member. The invention comprises means positioned within the second housing for engageably rotatably supporting the collar member to provide rotational reaction forces to the collar member in a generally longitudinal direction with respect to the first housing to maintain the preselected relation between the tubular member and the outer member as determined by the configuration of the free end portions of the reversible collar in any of the given positions.

In a preferred embodiment, means are positioned within the opening of the second housing and adapted to releasably retain an end portion of the reversible collar within the second housing, wherein the means is an elastomer member.

BRIEF DESCRIPTION OF THE DRAWINGS

The above and other objects, features, and advantages of the present invention will become apparent upon reading a detailed description of a preferred embodiment thereof when viewed in conjunction with the accompanying drawings.

DETAILED DESCRIPTION

Figures 1, 2, 3, 4:
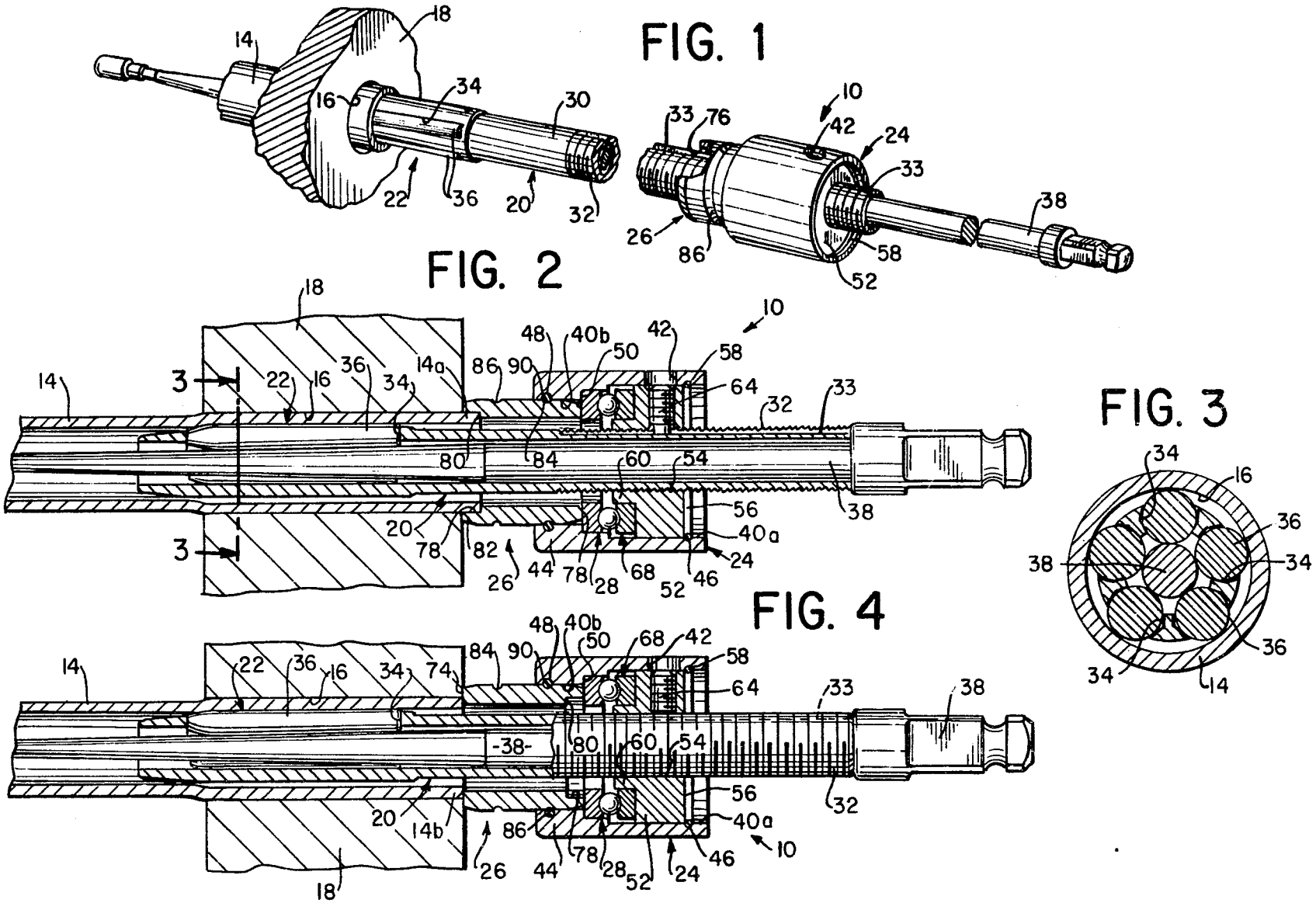
FIG. 1 represents a fragmentary diagrammatic perspective view of a novel and improved thrust collar apparatus embodying the principles of the present invention shown cooperating with a standard tube expanding assembly which is depicted in the process of being inserted into a tube that projects from a tube sheet structure.
FIG. 2 represents a cross-sectional view of the thrust collar apparatus made in accordance with this invention shown cooperating with the standard tube expanding assembly and a tube having one end extending outwardly from the face of the tube sheet.
FIG. 3 represents a cross-sectional view of a tube expanding member taken substantially along the section line 3-3 appearing in FIG. 2 looking in the direction of the arrows and illustrating more details as to the tube expanding assembly.
FIG. 4 represents a cross-sectional view of the novel and improved thurst collar apparatus similar to that shown in FIG. 2, but, however, depecting it with a component thereof reversed so as to cooperate with and accommodate a tube having one end flush with the face of the tube sheet during the tube expanding operation.

Initial reference is made to FIG. 1 wherein the novel and improved versatile expanding apparatus embodying the principles of this invention and generally designated by reference character 10 is shown. The expanding apparatus 10 is insertable within metallic tube 14 or other like expandable hollow member received within a corresponding opening 16 formed in a stationary outer member or tube sheet 18 so as to expand the wall of the tube into a tight frictional engagement with the tube sheet portion defining the opening 16. Tube expanding apparatus 10 is versatile insofar as it can expand tubes 14 which are to have an end portion **14*a* extend with the sheet 18, such as shown in FIG. 2, or an end portion 14*b* flush with the sheet as shown in FIG. 4. This type of tube expansion is frequently applied in the heat exchanger and condenser field. Accordingly, a single apparatus 10 may be used to expand tubes 14 which are to have end portions flush with the tube sheet 18** or project therefrom.

Tube expanding apparatus 10 includes first housing 20, expanding means 22 for expanding end portions of a tube 14, second housing 24, reversible collar 26, and rotatable suppporting means 28. The first housing 20 is defined by a generally elongated hollow cage member 30 having a portion thereof which is externally threaded at 32 and includes a longitudinal flat groove 33 being adapted to cooperate with the second housing 24 in a manner to be more completely described hereinafter. Also, adjacent the forward end of the cage 30 is a plurality of discrete longitudinally extending and circumferentially spaced slots 34 which have their long axes at a skew relative to the axis of the cage 30.

Expanding means 22 includes conventional elongated expanding rollers 36 suitably fit within the cage slots 34 and generally elongated mandrel 38. The rollers 36 are arranged to contact the tube 14 so as to be, preferably, in an inclined or canted position with respect to the axis of the cage. The mandrel 38 is a generally elongaged member having a taper opposite that of the rollers 36 and is positioned between such rollers and inserted into the first housing 20 to operatively cooperate with the rollers to outwardly expand the tube and develop generally axial and substantially inward forces. As will be subsequently more fully described in operating the tube expanding apparatus 10, it will be appreciated that the mandrel 38 and cage member 36 are inserted within the tube 14 to be expanded.

Now referring to the second housing means 24, reference is made to FIG. 2 taken in conjunction with FIG. 4, wherein the details thereof may be more fully denoted and defined by a cylindrical outer housing with an internal bore 40 axially extending therethrough and defining enlarged opposite open end portions **40*a* and 40*b*, respectively. The outer second housing member 24 may have at least one radially extending opening 42 formed through sidewall 44 thereof. A pair of first and second separate, internal retaining grooves 46 and 48, respectively, are formed in the sidewall 44 so that each one is generally circumferential and situated adjacent a respective open end of the outer housing 24. An internal retaining shoulder 50 is formed adjacent one of the retaining grooves 46** for reasons hereinafter made apparent.

The second housing includes an inner thrust nut member 52, as best shown in FIGS. 2 and 4. Threaded nut member 52 is defined by a suitably formed internally threaded internal bore portion 54 extending throughout the longitudinal extent thereof. It will be apparent that the inner thrust nut member 52 threadedly cooperates with the threaded portion 32 formed on cage member 30. The inner thrust nut member 52 is formed with a generally flat end surface 56, which at one end abuttingly engages a retaining ring 58 which may be of a conventional type. The retaining ring 58 is suitably and easily inserted into and removed from the retaining groove 46 for purposes of assembling and disassembling the inner thrust nut member 52 to the second outer housing 24. In the foregoing assembled position, the inner thrust nut member 52 is prevented from undesired axial movement relative to the outer housing 24. An annular flange memer 60 outwardly projects from the opposed end surface of the thrust nut member 52. The flange 60 has securely seated thereon a portion of rotatable supporting means 28. Also, the inner thrust nut member 52 is formed with a thrreaded internal radial bore 62 through a wall thereof. The threaded bore 62 is adapted, whenever assembled, to threadedly cooperate with the set screw 64 such as shown in FIGS. 2 and 4. The bore 62 is arranged to be in alignment with opening 42 formed in the sidewall of the outer housing 24. The set screw 64 is appropriately adjusted to advance and retract the same from contact with the flat groove 33 formed along a portion of cage 30 so as to releasably secure the inner thrust member 52 to the cage at preselected locations for reasons made evident. It is noted that the top of set screw 64 does not protrude into opening 42 thereby ensuring relative rotation between the inner thrust member 52 and outer housing member 24.

FIGS. 2 and 4 best disclose the rotatable supporting means 28 which in the illustrated embodiment may be defined by a conventional thrust bearing 68 assembly that is seen to comprise an inner support race member, outer race member, and a plurality of roller bearing elements interposed therebetween in a suitable fashion. As depicted, the inner race member snugly sits on the annular flange 60 projecting from the end surface of the inner thrust nut member 52. On the other hand, the outer race member is adapted to engage and remain in contact with the internal shoulder 50. Accordingly, the rotatable supporting means 28 is suitably retainable in the outer housing 24. It will be appreciated that rotatable supporting means 28 engageably rotatably supports the collar member 26 so as to provide rotational reaction forces to the collar in a generally longitudinal direction with respect to the first outer housing 24 to maintain a pre-selected relation between the tube 14 and tube sheet 18 as determined by the configuration of the collar 46 in a manner to be described.

Referring to the novel and improved reversible thrust collar sleeve member 26, it will be noted that such is defined by a generally elongated hollow member which may have a generally cylindrical configuration. The collar sleeve member 26 has a generally flat end portion surface 74 which may be transverse to the axis of the sleeve 26. The opposite situated end portion of the collar sleeve 26 is formed with a generally recessed portion 78 defining a recessed shoulder 80 and overhanging flange 82.

As shown in FIG. 2, the overhanging flange 82 is of such a diameter as to exceed that of the tube 14, the tube expanding apparatus 10 is to be used to expand. In one working situation, the extent tube end **14*a* will protrude from the face of sheet 18 is determined by the location of the shoulder 80 from the free end of the sleeve 26. On the other hand, end portion surface 74 is adapted to conjointly contact tube end 14*b* and tube sheet 18 whenever the tube is to be expanded to have its end 14*b* flush with the sheet. A pair of first and second discrete peripheral locking groove depressions 84 and 86, respectively, are formed on the outer surface of the collar sleeve 26**.

As depicted in the drawings, either end portion 74 and 76 of the cylindrical collar sleeve 26 is adapted to partially extend into the end portion of bore 56 of the second or outer housing member 24 and engage the rotatable supporting means 28 which is adjacent the thrust nut member 52. Each of the circumferential sleeve grooves 84 and 86 are spaced from a respective end of the sleeve 26 by a distance such that either groove is engageable with means which releasably retain end portions 74 and 76 within first housing 24.

The means in this embodiment is defined by a resilient elastomer O-ring member 90 that is of a dimension and resiliency which cooperates with both the retaining groove 48 and either of the peripheral sleeve locking grooves 84 and 86 so as to lock the second housing 24 and collar sleeve 26 together. It will be appreciated that to either insert or remove the collar sleeve 26 from the second housing member 24, the former is inserted into the latter whereby the sleeve will serve to initially generally radially compress the ring 90 thereby permitting one end of the sleeve 26 to engage the rotatable supporting means 28. Since both the first and second peripheral grooves 84 and 86 are arranged to be, whenever the sleeve 26 is in the assembled condition, radially aligned with each other, the compressed O-ring 90 by virtue of its inherent resiliency will expand into a tight-fit engagement with either one of the sleeve grooves 84 and 86. In this particular manner, the first housing 24 and sleeve 26 are locked together. Thus, for example, should O-ring 90 frictionally and resiliently cooperate with groove 84, the recessed end portion 78 will be useable in connection with tubes 14 having an end **14*a* protrude. Alternatively, whenever resilient O-ring 90 likewise cooperates the groove 86, the flat surface 74 of collar sleeve 26 is adapted to engage tube ends 14*b* which are to be flush with the tube sheet 18. To separate the collar sleeve 26 so that it may be reversed in an end-to-end fashion, such as indicated by the respective positions in FIGS. 2 and 4, an operator merely has to exert sufficient axial pulling force. As the reversible sleeve 26 is pulled, the resilient O-ring member 90 will be compressed, radially outwardly relative to the sleeve 26 thereby permitting complete separation of the collar sleeve from the housing 24. Once the reversible sleeve 26 has been separated, the resilient O-ring 90 will assume its non-deformed condition. Accordingly, the retaining O-ring 90 is designed to cooperate and frictionally hold the collar sleeve 26 in its position, such as indicated in both FIGS. 2 and 4**.

After having explained the foregoing described organization of components, it is believed that the operation thereof is evident. To facilitate such an understanding, however, it will be understood that to operate the tube expanding apparatus 10, it is operated in the following fashion so as to cooperate with and expand tubes which are to either project from or be flush with the tube sheet.

In order to expand tubes 14 which have their ends **14*a* projecting from the front face of a tube sheet 18, such as shown in FIG. 4, the collar sleeve 26 has its recessed end portion 78 extending outwardly from the second housing member 24. It is appreciated, of course, that the first end surface 74 of the collar sleeve 26 is received within the first housing 24 so that resilient retaining O-ring 90 snaps into the groove 84. In conventional fashion, the expanding tool apparatus 10 is inserted into the open end of the tube 14 and the mandrel 38 is rotated. In response to this rotation of mandrel 38, the tube expanding apparatus 10 is pulled relatively into the tube 14 while the tube has a tendency to be pulled outward relative to the tube sheet until the end face of the overhanging flange 82 abuts against the tube sheet 18 such that the flange overlies the outer end 14***a* of tube 14. Further rotation of the mandrel 38 causes tube 14 to be pulled outwardly relative to the tube sheet 18 and into and beneath the sleeve flange 82 until tube end 14*a* abuts against the internal shoulder 80. Accordingly, no further outward movement of the tube 14 during the subsequent expansion operation occurs.

Should it be desired to expand tubes 14 which are to have an end 14*b* flush with respect to the outer face of the tube sheet 18, the operator merely has to separate the collar sleeve 26 from the second housing member 24. To effectuate such action, the operator separates the sleeve 26 from the housing 24 by pulling with sufficient force to overcome the resilient bias afforded by the retaining O-ring 90. After completion of the separation, an operator inserts the recessed end portion 78 of the collar sleeve 26 into the housing 24, such that it enages rotatable support means 28. As noted in the engaged position, it provides rotational reaction forces to the collar 20 in a generally longitudinal direction with respect to the first housing so as to maintain the preselected relation between the tube 14 and tube sheet as determined by the noted first and second free end portions 74 and 76, respectively, in any given position. It is apparent that the resilient retaining O-ring 90 will snap into the peripheral groove depression 86 to secure the collar sleeve 26 within the housing 24. In conventional fashion, the tube expanding apparatus 10 is inserted within the tube 14 and the mandrel 38 is rotated. In this particular operation, the tube 14 which has a tendency to be pulled outwardly from the tube sheet 18 and is prevented from doing so because it contacts end surface 74 which engages sheet 18. As a consequence thereof, the tube 14 is prevented from being further outwardly removed from the tube sheet during the expansion process.

By virtue of the above description, the tube expanding apparatus 10 is an extremely simple to manufacture and highly reliable device which can be easily and quickly adapted to accommodate for tubes which are either flush or extend from the face of the tube sheet. Thus, an operator need not in expanding tubes which extend from the tube sheet or situated within the tube sheet so as to be flush with the tube sheet constantly and precisely adjust the position of the adjustable stop collar. In the present invention, an operator merely separates the collar sleeve from the housing and reverses in end-to-end fashion the location of the collar sleeve with respect to the housing so that the opposed flush and recessed ends may suitably cooperate with a particular tube they are to expand to a tight fit with the tube sheet 18.

While the invention has been described in connection with the preferred embodiment, it is not intended to limit the invention to the particular form set forth above, but, on the contrary, it is intended to cover such alternatives, modifications, and equivalents as may be included within the spirit and scope of the invention as defined by the appended claims.

What is claimed is:

1. An apparatus for expanding an end portion of a tubular member positioned within an opening defined by an outer member, which comprises a generally elongated first housing having one end portion adapted to be rotatably inserted into the tubular member, means mounted in said housing for expanding the end portion of the tubular member outwardly in engaged relation with peripheral portions of the opening and for developing forces directed axially into the tubular member, a second housing adapted to be securedly positioned along pre-selected locations of said first housing and having at least a first open end portion positioned to face said outer member and the end portion of the tubular member, a reversible collar member having first and second free end portions adapted to be removably positioned within the opening of said second housing in at least one of two positions, the first position wherein the first free end portion is configured to be engaged at least with said outer member in a manner to permit the tubular member to be expanded so as to extend a predetermined distance outwardly of the said outer member and a second position wherein the second free end portion is configured to be engaged at least with said outer member to retain the end of the tubular member substantially continuous with surface portions of said outer member, means positioned within said second housing for engageably rotatably supporting said collar member to provide reaction forces to said collar member in a generally longitudinal direction with respect to said first housing during rotation thereof so as to maintain the preselected relation between said tubular member and said outer member as determined by the configuration of the free end portion of said reversible collar in any given position, and resilient means positioned within said second housing and being adapted to releasably retain either of said end portions of said reversible collar within said second housing for permitting said collar to be releasably installed and removed in response to generally axially directed forces.

2. The apparatus as set forth in claim 1, wherein said resilient means to retain the end portion of said reversible collar within said second housing comprises an elastomeric member.

3. The apparatus as set forth in claim 2, wherein said open end portion of said second housing defines a peripheral groove and said elastomeric member is an O-ring dimensioned to be engageably received at least partially within said groove.

4. The apparatus as set forth in claim 3 wherein said first housing comprises an elongated housing which defines a plurality of generally elongated slot openings therethrough positioned thereabout; and said means for expanding the tubular members including rolling means mounted for rotation within each slot opening and dimensioned and oriented such that insertion of said first housing into an end portion of the tubular member and rotating said housing in a manner to cause the rolling means to engage and roll along inner surface portions of the tubular member while simultaneously causing said rolling means to be directed radially outwardly in engagement with said inner wall portions of the tubular member, expands the end portion of the tubular member while progressively developing traction forces which direct the housing inwardly of the tubular member; and an elongated tapered member positioned within an opening defined by said first housing.

5. The apparatus as set forth in claim 4 wherein said tapered member has a portion which engages portions of the rolling means such that further rotational movement into the first housing causes the rolling means to move outwardly into further engagement with inner surface portions of the tubular member to develop the inward traction forces on said first housing while expanding an end portion of the tubular member.

6. The apparatus as set forth in claim 2 wherein said first end portion has a recessed configuration including a shoulder adapted to abut ends of a tube, and an overhanging flange which is adapted to surround the protruding portion of the tube as well as to contact the outer member such that the first end portion defines the extent the tube end projects from the outer member.

7. The apparatus as set forth in claim 6 wherein said second end portion is configured to simultaneously engage both the outer member and tube end so as to maintain the tube end flush with the outer member during the expanding operation.

8. The apparatus set forth in claim 7 wherein said collar member has a pair of locking grooves located on one side of the corresponding external surfaces thereof and each one being adjacent end portions of the collar and being adapted to frictionally cooperate with said means for releasably retaining the corresponding end portion of said collar in said second housing.

9. The apparatus as set forth in claim 2 wherein the second housing includes a tubular outer housing, and an inner thrust member internally disposed relative to the outer housing and threadedly connected to the first housing so as to be positioned at pre-selected locations along the first housing.

10. The apparatus as set forth in claim 9 wherein said rotatable supporting means is defined by a thrust bearing assembly which is retained by and between said outer housing and said inner thrust member and adapted to engage either of said first and second end portions whenever in any of the given positions.

11. An apparatus for expanding an end portion of a tubular member positioned within an opening defined by an outer member which comprises a generally elongated first housing having one end portion adapted to be rotatably inserted into the tubular member, means mounted in said housing for expanding the end portion of the tubular member outwardly in engaged relation with peripheral portions of the opening and for developing forces directed axially into the tubular member, a second housing adapted to be securedly positioned along pre-selected locations of said first housing and having at least a first open end portion positioned to face said outer member and the end portion of the tubular member, a reversible collar member having first and second free end portions adapted to be removably positioned within the opening of said second housing in at least one of two positions, the first position wherein the first free end portion is configured to be engaged at least with said outer member in a manner to permit the tubular member to be expanded so as to extend a predetermined distance outwardly of the said outer member and a second position wherein the second free end portion is configured to be engaged at least with said outer member to retain the end of the tubular member substantially continuous with surface portions of said outer member, resilient means positioned within said second housing and being adapted to releasably retain either of said end portions of said reversible collar within said second housing for permitting said collar to be releasably installed and removed in response to generally axially directed pushing and pulling forces, respectively, means positioned within said second housing for engageably rotatably supporting said collar member to provide reaction forces to said collar member in a generally longitudinal direction with respect to said first housing during rotation thereof so as to maintain the preselected relation between said tubular member and said outer member as determined by the configuration of the free end portion of said reversible collar in any given position, wherein the open end portion of said second housing defines a peripheral groove and said resilient means for releasably retaining either of said first and second end portions in said second housing is an elastomeric O-ring positioned within said groove and being dimensioned to be engageably received within at least a portion of said peripheral groove.

12. An apparatus for expanding an end portion of a tubular member positioned within an opening defined by an outer member, which comprises a generally elongated first housing having one end portion adapted to be rotatably inserted into the tubular member, means mounted in said housing for expanding the end portion of the tubular member outwardly in engaged relation with peripheral portions of the opening and for developing forces directed axially into the tubular member, a second housing adapted to be securedly positioned along preselected locations of said first housing and having at least a first open end portion positioned to face said outer member and the end portion of the tubular member, a reversible collar member having first and second free end portions adapted to be removably positioned within the opening of said second housing in at least one of two positions, the first position wherein the first free end portion is configured to be engaged at least with said outer member in a manner to permit the tubular member to be expanded so as to extend a predetermined distance outwardly of the said outer member and a second position wherein the second free end portion is configured to be engaged at least with said outer member to retain the end of the tubular member substantially continuous with surface portions of said outer member, resilient means positioned within said second housing and being adapted to releasably retain either of said end portions of said reversible collar within said second housing for permitting said collar to be releasably installed and removed in response to generally axially directed pushing and pulling forces, respectively, means positioned within said second housing for engageably rotatably supporting said collar member to provide reaction forces to said collar member in a generally longitudinal direction with respect to said first housing during rotation so as to maintain the pre-selected relation between said tubular member and said outer member as determined by the configuration of the free end portion of said reversible collar in any given position, the open end portion of said second housing defining a peripheral groove and said means for releasably retaining either of said first and second end portions of said second housing being an elastomeric O-ring positioned in said groove, said O-ring being dimensioned to be engageably received at least partially within said groove, said first end portion having a recessed configuration including a shoulder adapted to abut ends of a tube and an overhanging flange adapted to surround the protruding portion of the tube and to contact the outer member such that the first end portion limits the projection of the tube end from the outer member, said second end portion being configured to simultaneously engage the outer member and the tube end so as to maintain the tube end in flush relation with the outer member during the expanding operation, the external surface of said collar member defining at least one pair of locking grooves, each groove being dimensioned to engageably receive at least a portion of said O-ring and being adjacent one of the corresponding end portions of said collar so as to cooperate with said O-ring for releasably retaining the corresponding end portion of said collar in said second housing.

* * * * *

UNITED STATES PATENT AND TRADEMARK OFFICE

CERTIFICATE OF CORRECTION

PATENT NO. : 4,099,400

DATED : July 11, 1978

INVENTOR(S) : Donald E. Schott

It is certified that error appears in the above-identified patent and that said Letters Patent are hereby corrected as shown below:

IN THE ABSTRACT

Last line, after "member." insert the following sentence:

-- A thrust bearing is positioned within the second housing for engageably rotatably supporting the collar member to provide rotational reaction forces to the collar member in a generally longitudinal direction, with respect to the first housing to maintain the pre-selected relation between the tube and outer member, as determined by the configuration of the free end portions of the reversible collar in any of the given positions. --

Column 2, line 16, "external" should read:

-- internal --

UNITED STATES PATENT AND TRADEMARK OFFICE

CERTIFICATE OF CORRECTION

PATENT NO. : 4,099,400

DATED : July 11, 1978

INVENTOR(S) : Donald E. Schott

It is certified that error appears in the above-identified patent and that said Letters Patent are hereby corrected as shown below:

Column 3, line 61, "depecting" should read:

-- depicting --

Column 4, line 21, "suppporting" should read:

-- supporting --

Column 5, line 11, "memer" should read:

-- member --

Column 5, line 15, "thrreaded" should read:

-- threaded --

Column 9, line 21 (Claim 8, line 3), after "one" and before "of" delete "side"

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*